United States Patent [19]

Richardson

[11] Patent Number: 4,607,693

[45] Date of Patent: Aug. 26, 1986

[54] SIDE-ENTRY SUB

[75] Inventor: Neil W. Richardson, Lafayette, La.

[73] Assignee: Schlumberger Technology Corporation, Houston, Tex.

[21] Appl. No.: 700,207

[22] Filed: Feb. 11, 1985

[51] Int. Cl.[4] ..... E21B 17/00

[52] U.S. Cl. ..... 166/242; 166/65.1; 166/177; 166/385; 174/47

[58] Field of Search ..... 166/65.1, 177, 242, 166/385; 175/104; 174/47

[56] References Cited

U.S. PATENT DOCUMENTS

| | | | |
|---|---|---|---|
| 3,825,079 | 7/1974 | Heilhecker | 166/385 X |
| 3,918,537 | 11/1975 | Heilhecker | 174/47 X |
| 3,957,118 | 5/1976 | Barry et al. | 166/385 |
| 4,062,551 | 12/1977 | Base | 277/102 |
| 4,181,184 | 1/1980 | Scherbatskoy | 174/47 X |
| 4,200,297 | 4/1980 | Tricon | 277/102 |
| 4,271,908 | 6/1981 | Robinson, Jr. et al. | 174/47 X |
| 4,367,797 | 1/1983 | Brown | 166/380 |
| 4,388,969 | 6/1983 | Marshall et al. | 166/242 |
| 4,506,729 | 3/1985 | Davis, Jr. et al. | 166/242 X |
| 4,524,834 | 6/1985 | Barron et al. | 166/385 |

FOREIGN PATENT DOCUMENTS 2744829 4/1979 Fed. Rep. of Germany .... 166/65 R

*Primary Examiner*—Stephen J. Novosad
*Assistant Examiner*—John F. Letchford
*Attorney, Agent, or Firm*—Francis Hagel; Michael D. Rostoker

[57] ABSTRACT

A side entry sub is disclosed having a stripping passage between the lower end of the sub and a recess in the sub body. A stripping element is disposed in the stripping passage to sealingly strip a logging cable as it moves into or out of the pipe string attached to the sub. A cable slot is provided in the outer part of the body and extends from a side opening to an opening in the recess. Upper and lower sheave wheels are rotatably mounted near the side opening and the recess opening operably providing a rotatable change of direction of a logging cable from outside the sub to the interior of an attached pipe string. The rotatable change of direction by rotation of the logging cable via the sheave wheels minimizes frictional resistance when it is running into or out of the pipe string.

14 Claims, 6 Drawing Figures

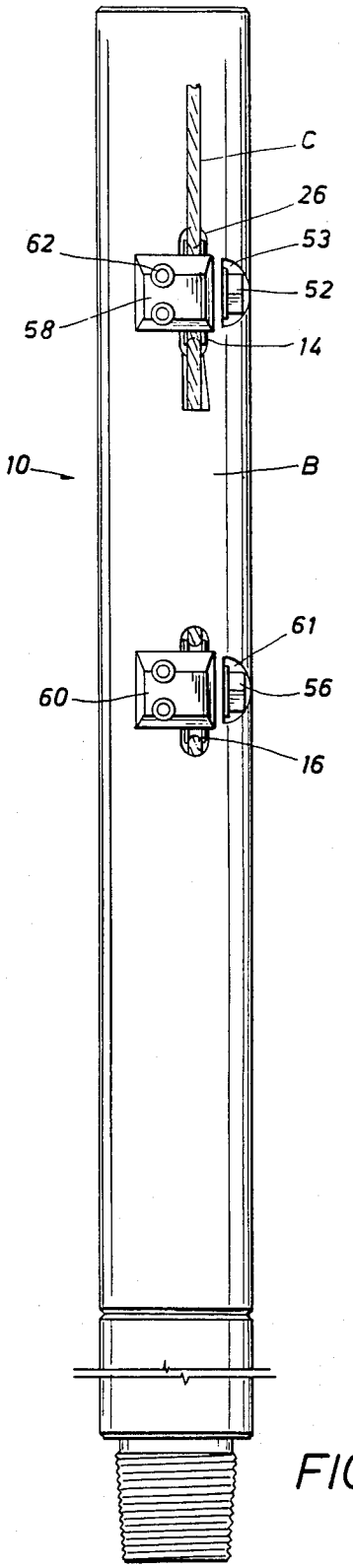
FIG. 2
FIG. 1
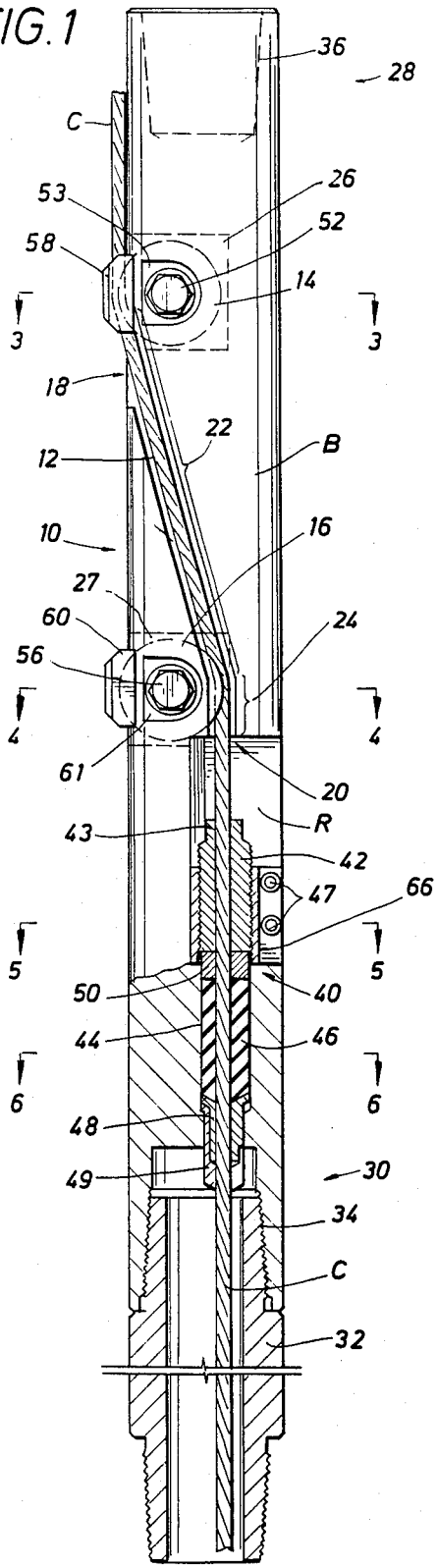

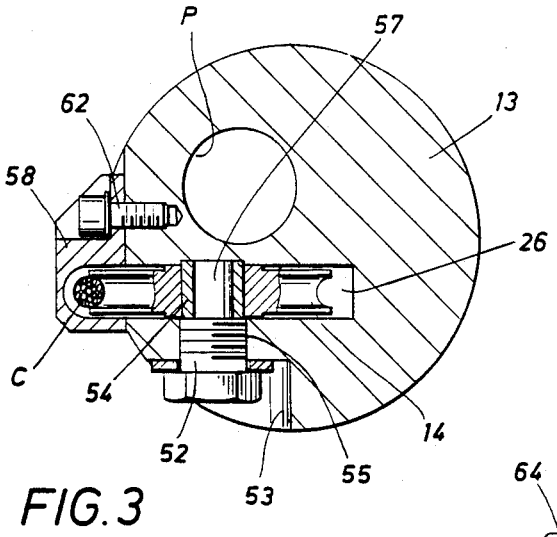
FIG. 3
FIG. 4
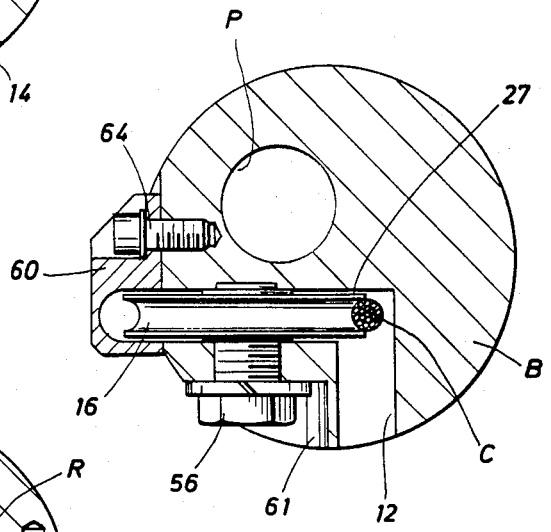
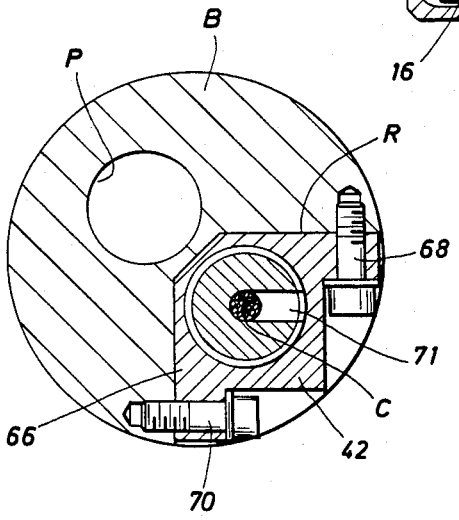
FIG. 5
FIG. 6
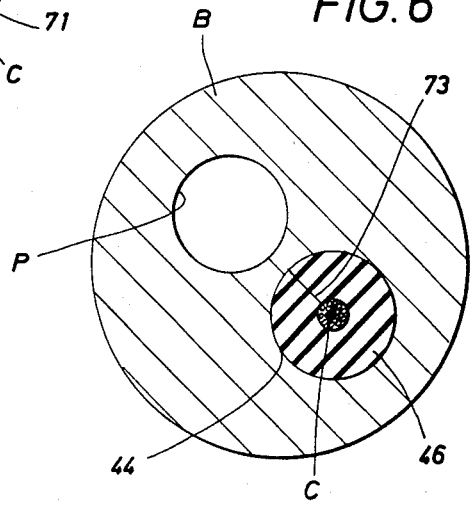

SIDE-ENTRY SUB

BACKGROUND OF THE INVENTION

1. Field of the Invention

This invention relates to a sub connectable in a drill string for facilitating entry and exit of a flexible line between the exterior and interior of the drill string. The flexible line may be, for example, a logging cable or a flexible tube.

2. Description of the Prior Art

Side-entry subs have at least two applications in the drilling art. One such application is for a steering system used with a mud motor. In such an application a wireline is suspended along the outside of the drill string, enters the string through the body, and is secured therein through a side-entry packoff often disposed near the drilling head. For example, U.S. Pat. No. 4,388,969 to Marshall et al., discloses a side-entry sub which connects a steering tool with surface monitoring equipment by means of a wireline thereby permitting continuous steered drilling. The apparatus of the Marshall patent may also allow entry of the wireline from outside the drill string to its interior while logging a highly deviated hole. The Marshall patent includes a passage through the wall of the body of the sub and provides a means for sealing a cable running through the passage with respect to the pressurized drilling fluid flowing through a longitudinal bore of the sub.

A disadvantage of the apparatus of the Marshall patent is that a wireline cable, entering the pipe string via the sub or exiting the pipe string during logging of the well, faces extremely high frictional forces due to the frictional contact of the cable on angular bends and turns in the passage. The force required to overcome such frictional drag on the logging cable may be so great as to prevent the effective logging of the well due to either exceeding the tension capability of the cable or the pulling capability of a logging winch. The armour of the logging cable may experience rapid wear and failure due to the constant frictional wear.

Another example of a side-entry sub is that disclosed in French patent publication No. 2,502,236 of Sept. 24, 1982, and assigned to Institut Francais du Petrole (I.F.P.). The side-entry sub disclosed in the I.F.P. patent publication includes a detachable sheath which is inserted in an inclined recess formed in the wall of the tubular body of the sub. The sheath has a drill hole provided through it. A portion of the drill hole has a diameter substantially equal to that of the logging cable and another portion of it accommodates a sealing apparatus. The sheath extends on the inner side of the sub into a member for guiding the cable at the outlet of the sheath so as to limit the curvature of the cable.

The I.F.P. apparatus suffers from the same sort of disadvantage as does the Marshall et al. patent in that frictional forces of a non-movable guide may also produce unacceptably large drag forces during the logging of the well as the logging cable is spooled out of the pipe string and through the sub.

IDENTIFICATION OF THE OBJECTS OF THE INVENTION

It is therefore an object of the invention to provide a side-entry sub which operably minimizes the frictional resistance of a logging cable on entry into or exit out of the interior of a drill string to which the sub is attached.

It is a further object of the invention to provide a side-entry sub apparatus in which a logging cable may be easily inserted and installed into the interior of a drill string.

SUMMARY OF THE INVENTION

The above mentioned objects of the invention as well as other advantages and features of it are provided in a side-entry sub having a body connectable to a pipe string. The sub has a longitudinal fluid passage through its body for drilling fluid communication between upper and lower pipe strings when connected to it. The body has a stripping element disposed in a stripping passage in the sub body. The stripping passage extends between the lower end of the body and a recess in the exterior wall of the sub body. The stripping element is adapted to allow a flexible line such as a logging cable to move through it while sealing it against pressurized drilling fluid in the interior of the drill string.

A cable slot is formed in the exterior of the body and runs diagonally from a side opening in the body to a recess opening intersecting the recess in the body. A lower sheave wheel is removably longitudinally mounted to the body and is disposed at the recess opening. A portion of the outer edge of the lower sheave wheel rotatably occupies a portion of the cable slot. An upper sheave wheel is removably longitudinally mounted to the body at the entry opening. A portion of the outer edge of the upper sheave wheel rotatably extends beyond the edge of the body.

The upper and lower sheave wheels in the cable slots are arranged so that the logging cable may extend from the outside of the body about the upper sheave wheel along the cable slot, about the lower sheave wheel and to the interior of a connected pipe string via the stripping element.

Preferably the cable slot intersects the recess at the recess opening substantially in line with the stripping passage.

The upper sheave wheel is rotatably mounted in a longitudinal slot formed adjacent the side opening in the body. The upper sheave wheel partially extends beyond the outer edge of the body. During logging operations, the cable moves into and out of the sub by rotatably changing direction from the cable slot to the exterior of the sub body and vice versa operably minimizing frictional wear on the cable.

The lower sheave wheel is rotatably mounted in a lower longitudinal slot formed adjacent the recess in the body. The lower longitudinal slot partially intersects the cable slot. Preferably the lower sheave wheel is disposed relative to the stripping element below such that the cable as it runs out of the lower sheave wheel is substantially aligned with respect to the axis of the stripping element. A logging cable moving into or out of the sub rotatably changes directions from the diagonal slot to the recess in the sub body and vice versa during logging operations further operably minimizing frictional wear on the cable. Preferably the cable slot is uncovered in the tubular body of the sub to facilitate installation of the logging cable in the sub.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIG. 1 illustrates a side view of the side-entry sub according to the invention shown partly in section and indicating connection means at either end thereto for connecting with a drilling pipe string;

FIG. 2 illustrates another side view of the invention but turned ninety degrees with respect to the view of FIG. 1 and illustrating the invention with a logging cable extending from the outside of the sub and into the interior of a connected pipe string;

FIG. 3 is a view taken along lines 3—3 of FIG. 1 and illustrating in cross-section, the body and partially in cross-section the mounting and orientation of the upper sheave wheel and the cable passing along its outer edge;

FIG. 4 is a view taken along lines 4—4 of FIG. 1 and illustrates partially in cross section the body and the lower sheave wheel and further shows the orientation of the logging cable about the inner edge of the sheave wheel;

FIG. 5 is a cross-sectional view taken along lines 5—5 of FIG. 1 which illustrates the orientation of a cable through a threaded nut which is a part of the stripping element provided with the invention; and FIG. 6 is a cross-section taken along lines 6—6 of FIG. 1 and illustrates the cable passing through sealing glands surrounding the cable in the stripping element.

DESCRIPTION OF THE INVENTION

FIG. 1 illustrates the side-entry sub 10 according to the invention. A body B is provided with threads 34 at its lower end 30 to threadedly connect with a drill string 32. Likewise, upper threads 36 at the upper end 28 provide for connection of the upper part (not shown) of a drill string to the side-entry sub 10. A cable slot 12 and an upper sheave wheel 14 and a lower sheave wheel 16 provide friction minimizing entry of cable C to stripping element 40 as cable C runs into or out of the interior of lower pipe section string 32. The cable slot 12 through which the cable C runs includes a diagonal portion 22 intersecting a longitudinal portion 24. The upper part of the cable slot 12 opens to the side of the body B at side opening 18. A passage means including a recess R and a stripping passage 44 are provided in the lower part of the body B. The recess R in the tubular body B has a recess opening 20 through which the cable C runs.

A stripping element 40 is disposed in the stripping passage 44 extending between the end of the lower end 30 of body B and the recess R. The stripping element 40 includes inserts 48, 49 through which the cable C passes and a sealing gland 46 which envelops the cable C passing therethrough. The inserts 48, 49 are preferably mating half pieces and have a slot therein for insertion of cable C while installing the components of stripping element 40. Sealing gland 46 is preferably a single elastomeric unit with a longitudinal slot or slit in it so that the cable may be inserted in it on installation of the cable and the stripping element in passage 44. A slotted retainer 50 is provided atop the sealing glands 46.

A guide 66 is provided in the lower portion of the recess R and is secured to the body B by means of threaded bolts 47. A threaded nut 42 having a longitudinal slot running therethrough in which the cable C may be inserted has threads for engaging threads of the guide 66. A wrench may engage the head 43 of threaded nut 42 for turning it and causing it to move downwardly. Downward movement of the nut 42 causes the sealing gland 46 to extrude inwardly toward the cable C thereby providing the proper amount of pressure with respect to the cable to allow it to be stripped through the stripping element 40. It is to be noted that the threaded nut 42 and the guide 66 may be inserted into the recess by providing the cable through the slot 71 shown in more detail in FIG. 5 and to be discussed again below.

FIG. 2 illustrates the side-entry sub 10 in a side view taken ninety degrees from that illustrated in FIG. 1. Cable C is illustrated entering the side-entry sub from an upper longitudinal position via the side opening 18 and the upper longitudinal slot 26 and further illustrating the upper sheave wheel 14 and the lower sheave wheel 16 in the lower longitudinal slot 27.

FIG. 3 illustrates the upper sheave wheel 14 and its disposition in an upper longitudinal slot 26 by means of a partial cross-sectional view taken along lines of 3—3 of FIG. 1. FIG. 3 illustrates the longitudinal bore or passage P that extends along the entire longitudinal extent of the body B. The longitudinal passage P allows drilling fluid (drilling mud) to pass from a drill string attached to the top of the body B to a drill string attached to the bottom of the body B.

FIG. 3 further illustrates the upper longitudinal slot 26 formed in the upper portion of the body B. An upper cut-out 53 is provided in the body and is further seen in FIG. 2. A threaded bolt 52 is provided through body B via a threaded hole 55 provided orthogonally to the upper longitudinal slot 26. The head of bolt 52 is disposed in cut-out 53. The upper sheave wheel 14 is placed in the upper longitudinal slot 26 and is rotatable about the extension 57 of threaded bolt 52. A bushing 54 is provided between extension 57 and the sheave wheel 14.

As illustrated in FIG. 3 the cable C is rotatably supported on the outer edge of the sheave wheel 14 and extends from the side of the body B as illustrated in FIGS. 1 and 2 to a surface winch (not shown). A cover plate 58 secured to the body B by means of threaded bolt 62 provides protection to cable C as it enters the body B. Protection of the sheave wheel 14 is also provided by cover plate 58.

Similarly as illustrated in FIG. 4 which is a cross-section through lines 4—4 of FIG. 1, the lower sheave wheel 16 is disposed in a lower longitudinal slot 27. The lower sheave wheel 16 is preferably disposed relative to the stripping element 40 below such that the cable, as it runs out of the lower sheave wheel, is substantially centered with respect to the axis of the passage 44 and the stripping element 40. A threaded bolt 56 is provided in a lower cut out 61 also illustrated in FIGS. 1 and 2. The lower sheave wheel 16 is rotatable about an extension of the threaded bolt 56. A bushing is provided about the extension in a similar fashion as that illustrated in FIG. 3 with respect to the upper sheave wheel 14. The lower longitudinal slot intersects the cable slot 12.

More particularly, the lower longitudinal slot 27 intersects the intersection of the diagonal portion 22 of cable slot 12 and the longitudinal portion 24 as illustrated more clearly in FIG. 1. The cable C engages the lower sheave wheel 16 inwardly as illustrated in FIG. 4 and runs to the upper sheave wheel 14 as illustrated in FIG. 1 where it outwardly engages the outer portion of the upper sheave wheel 14 as illustrated in FIG. 3. The lower sheave wheel includes a lower cover plate 60 removably secured to the body B by means of a threaded bolt 64. The lower cover plate 60 may also be seen in FIGS. 1 and 2 and provides working protection to the sheave wheel 16 as the side entry sub moves up and down a cased borehole during a logging operation.

FIG. 5 is a cross-section illustration of the side-entry sub taken along lines 5—5 through the threaded nut and the guide 66 of FIG. 1. The guide 66 is secured within the recess R to body B by means of threaded bolts 68 and 70, which correspond to the lower bolts, one upper and one lower bolt being generally designated as 47 in FIG. 1". FIG. 5 illustrates that threaded nut 42 has a slot 71 through which the cable C may be placed. Such slot facilitates the installation of the nut and guide in the recess R. A wrench may be applied to the top portion 43 of nut 42 to drive it downwardly with respect to the guide 66.

FIG. 6 is an illustration of the sealing gland 46 strippingly sealing with respect to cable C and body B. A slit 73 is provided in gland 46 to facilitate installation of it about cable C. FIG. 6 is an cross-section through the body B taken along lines 6—6 of FIG. 1.

Thus there has been provided a side-entry sub which includes a stripping element 40 which may be installed in a passage 44 via a recess R about a cable C. The invention also relates to the provision of a cable slot 12 through the side of the body B and includes an upper sheave wheel 14 and a lower sheave wheel 16, each rotatably secured to the body B about which a cable C may run into or out of the pipe string. The lower sheave wheel is disposed in such manner relative to the stripping element such that the cable, as it runs out of the lower sheave wheel, is substantially aligned with respect to the axis of the sealing stripping element. Providing the sheave wheels 14 and 16 in the manner illustrated in FIGS. 1, 2, 3 and 4 allows the cable C to move with a minimum of friction through the angles through which it must turn or pass. Such a minimum of friction enables the cable C to pass into the pipe string 32 below during pump down of the logging sonde with essentially only the stripping element providing a retarding force. Similarly the cable C may be withdrawn from the side-entry sub 10 and the pipe string string 32 below with a minimum of drag as the logging operation is occurring.

Various modifications and alterations in the described structures will be apparent to those skilled in the art of the foregoing description which does not depart from the spirit of the invention. For this reason, these changes are desired to be included in the appended claims. The appended claims recite the only limitation to the present invention in the descriptive manner which is employed for setting forth the embodiments and is to be interpreted as illustrative and not limitative.

What is claimed is:

1. In a side entry sub having a body connectable in a pipe string, said sub having a longitudinal fluid passage through said body for drilling fluid communication between upper and lower pipe strings when connected to said sub and having a stripping element disposed in a stripping passage in said sub body, said stripping passage communicating between the lower end of said body for movement of a logging cable between the interior of a connected pipe string and a recess in the exterior wall of said sub body, apparatus for faciltating entry and exit of a logging cable between the exterior and interior of said pipe string when connected to said sub comprising, a cable slot formed in the said body and running diagonally from a side entry opening in the body to a recess opening intersecting said recess, a lower sheave wheel removably longitudinally mounted to said body and disposed at said recess opening, a portion of the outer edge of said lower sheave wheel rotatably occupying a portion of said cable slot, and an upper sheave wheel removably longitudinally mounted to said body at said entry opening, a portion of the outer edge of said upper sheave wheel rotatably extending beyond the edge of said body, whereby said logging cable may extend from the outside of said body, about said upper sheave wheel, along said slot, about said lower sheave wheel, and into the interior of a connected pipe string via said stripping element.

2. The apparatus of claim 1 wherein said cable slot comprises a relatively long diagonal portion intersecting a relatively short longitudinal portion, said longitudinal portion formed between the lower end of the diagonal portion and the recess opening.

3. The apparatus of claim 1 wherein said cable slot is uncovered operably enabling installation of said logging cable within said sub.

4. The apparatus of claim 1 wherein said upper sheave wheel is rotatably mounted in a longitudinal slot formed adjacent said side opening in the body, said upper sheave wheel partially extending beyond the outer edge of said body, whereby a logging cable moving into or out of said sub rotatably changes direction from said cable slot to the exterior of the sub body and vice versa during logging operations operably minimizing frictional wear on said cable.

5. The apparatus of claim 4 wherein said upper longitudinal slot is mounted above said side opening, and said upper longitudinal slot at least partially intersects said diagonal slot.

6. The apparatus of claim 1 wherein said lower sheave wheel is rotatably mounted in a lower longitudinal slot formed adjacent said recess in said body, said lower slot partially intersecting said cable slot, said lower sheave wheel being mounted in said slot so that a logging cable passing about said wheel is brought into alignment with said stripping element, whereby a logging cable moving into or out of said sub rotatably changes direction from said diagonal slot to the recess in the sub body and vice versa during logging operations operably minimizing frictional wear on said cable.

7. The apparatus of claim 6 wherein said lower sheave wheel partially extends beyond the outer edge of said body.

8. A side-entry sub connectable in a pipe string for facilitating entry and exit of a flexible line between the exterior and the interior of the pipe string comprising, a body having threads at each end for connection in said pipe string, a longitudinal bore in said body providing drilling fluid communication through said body with said pipe string, a passage means formed in said body, a stripping means disposed at least partially within said passage means for sealing a flexible line with respect to said body while allowing said flexible line to pass through said passage means, a cable slot formed in the exterior of said body and running diagonally from a side opening in the body to an opening in said passage means, a lower sheave wheel removably rotatably mounted to said body and disposed above said passage means, and an upper sheave wheel removably rotatably mounted to said body and disposed above said side opening, whereby said flexible line may pass about said upper sheave wheel, through said slot and about said lower sheave wheel and through said stripping means into the interior of a pipe string coupled to the lower end of said body operably minimizing the frictional resistance of said flexible line between said side opening and said stripping means.

9. The sub of claim 8 wherein said upper sheave wheel is rotatingly mounted in a longitudinal slot formed adjacent said side opening in the body, said upper sheave wheel partially extending beyond the outer edge of said body, whereby a logging cable moving into or out of said sub rotatably changes direction from said diagonal slot to the exterior of the sub body and vice versa during logging operations operably minimizing frictional wear on said cable.

10. The sub of claim 8 wherein said flexible line is a logging cable.

11. The side-entry sub of claim 8 wherein said passage means includes, a recess formed in said body, and a passage formed between the lower end of the body and said recess, and said cable slot intersects said recess above said passage operably providing a path for said cable to be substantially axially aligned with said stripping means.

12. The sub of claim 11 wherein an upper longitudinal slot is mounted above said side opening and at least partially intersects with said diagonal slot.

13. The sub of claim 11 wherein said lower sheave wheel is rotatably mounted in a lower longitudinal slot formed adjacent said recess in said body, said lower slot partially intersecting said cable slot, said lower sheave wheel being mounted in said slot so that a logging cable passing about said wheel is brought into alignment with said stripping means whereby a logging cable moving into or out of said sub rotatingly changes direction from said cable slot to the recess in the sub body and vice versa during a logging operation operably minimizing frictional wear on said cable.

14. The sub of claim 13 wherein said lower sheave wheel partially extends beyond the outer edge of said body.

* * * * *